US006453142B1

(12) United States Patent
Ishii

(10) Patent No.: US 6,453,142 B1
(45) Date of Patent: Sep. 17, 2002

(54) DEVELOPING APPARATUS EQUIPPED WITH DEVELOPING ROLLER HAVING A DIELECTRIC LAYER OUTER SURFACE

(75) Inventor: Hiroshi Ishii, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 09/907,633

(22) Filed: Jul. 19, 2001

(30) Foreign Application Priority Data

Jul. 19, 2000 (JP) ..... 2000-219077

(51) Int. Cl.[7] ..... G03G 15/08

(52) U.S. Cl. ..... 399/286

(58) Field of Search ..... 399/159, 222, 399/252, 279, 280, 286, 53, 55

(56) References Cited

U.S. PATENT DOCUMENTS 4,899,689 A * 2/1990 Takeda et al. ..... 399/286
5,110,706 A 5/1992 Hosoya et al.

FOREIGN PATENT DOCUMENTS

JP 1-230079 A 9/1989
JP 3-87759 4/1991

OTHER PUBLICATIONS

Masahiro Hosoya et al., "Contact Type Monocomponent Nonmagnetic Development System (I)—Theory and Optimization–," Electrophotography (The Society Journal, Society of Electrophoyography Japan), vol. 31, No. 4, 1992, Japan, pp. 531–541. (with partial translation).

Masahiro Hosoya et al., "Contact–Type Development System Using Monocomponent Nonmagnetic Toner," Japan Hardcopy '89, theses collection, The Society of Electrophotography of Japan, Jul. 5–7, 1989, Japan, pp. 25–28 (with partial translation).

Fuchio Takeda et al., "NonMagnetic Single–Component Process Using Elastic Development Roller," Japan Hardcopy '88, The Society of Electrophotography of Japan, May 16–18, 1988, Japan, pp. 131–134.

* cited by examiner

*Primary Examiner*—William J. Royer

(57) ABSTRACT

An object of the invention is to facilitate the design of a developing apparatus by making it easier to set the optimal developing conditions in upgrading an image quality when forming an image with a dielectric developing roller. Developing conditions are set so as to satisfy $Cc \geqq \rho t \cdot dt \cdot k/Vv$, wherein $Vv=-(Vbp+Vpr)-Vco+Vt \cdot k$; $Cc=1/\{1/Cp+2/Ct+rr/k+1/(Cr3 \cdot k)\}$; $k=vr/vp$; $rr=\rho r \cdot d2$; $Cp=\in p/dp$; $Ct=2 \cdot \in t/dt$; $Cr1=\in 1/d1$; $Cr2=\in 2/d2$; $C1=1/\{1/Cp+2/Ct+1/(Cr1 \cdot k)\}$; $C2=k \cdot Cr2$; $Ex=(W/vp)/\{rr \cdot (C1+C2)\}$; $Cr3=Cr1 \cdot \{1-C1/(C1+C2)\} \cdot \exp(-Ex)$; $\rho t=(qpm+qr) \cdot m/dt$; $Vco=-qpm \cdot m/Cr1$; $Vpr=-qr \cdot m \cdot k/Cp$; $Vt=\rho t \cdot dt/Ct$.

6 Claims, 4 Drawing Sheets

DEVELOPING APPARATUS EQUIPPED WITH DEVELOPING ROLLER HAVING A DIELECTRIC LAYER OUTER SURFACE

BACKGROUND OF THE INVENTION

1. Field of the Invention

The present invention relates to a developing apparatus, provided in an image forming apparatus which electrophotographically forms an image, for developing an electrostatic latent image formed on a photosensitive body into a visible toner image, and more particularly to a developing apparatus equipped with a developing roller having a dielectric layer formed on its outer surface.

2. Description of the Related Art

There are known some types of an image forming apparatus that electrophotographically forms an image, employing a developing apparatus for developing an electrostatic latent image formed on the surface of a photosensitive body into a visible toner image by pressing a developing roller having a toner layer formed on its outer surface against the surface of the photosensitive body by a predetermined nip width during the developing process. There is known a developing roller provided in such a developing apparatus, including conductive elastic rubber of high resistance as its outer surface. However, an elastic material of high resistance exhibits considerable variations in resistance value, and an error in resistance value may occur among different developing rollers and among different portions in a single developing roller. Also, a variation in resistance value readily occurs with an external environment such as humidity.

Hence, there is known a dielectric developing roller for a conventional developing apparatus directed to stabilization of resistance value, comprising a conductive substrate, and a resistance layer and a dielectric layer which are formed on the outer surface of the conductive substrate in this order.

Japanese Unexamined Patent Publication JP-A 1-230079 (1989) discloses a monocomponent developing apparatus using a developing roller having at least a dielectric layer deposited on the top surface of a supporting layer made of an elastic material, wherein, based on a saturation development model of a capacitor type, resistance of the supporting layer is set lower than a value determined by a bias potential, an amount of charge of toner, etc.

Japanese Unexamined Patent Publication JP-A 3-87759 (1991) discloses a developing method of readily obtaining a sharp and uniform image of high density without any fog on the background by adjusting the following: an amount of charge of toner adhering to a surface holding an electrostatic latent image as a result of development; an amount of charge conferred to toner through frictional electrification with the surface holding the electrostatic latent image; an electric resistance value of a toner carrier; an effective length of the toner carrier; an effective area of the toner carrier; an amount of adhesion of toner on the surface holding the electrostatic latent image as a result of development; a moving rate of the surface holding the electrostatic latent image; an amount of adhesion of toner on the surface of the toner carrier; and a speed ratio between the surface of the toner carrier and the surface holding the electrostatic latent image.

However, none of the conventional dielectric developing rollers is arranged to upgrade an image quality during the image formation by making it easier to set developing conditions that exert influence upon a developing state during the developing process, including: a thickness and a dielectric constant of a photosensitive layer of the photosensitive body; a thickness, a dielectric constant, and an amount of adhesion per unit area of a toner layer formed on the developing roller; a thickness and a dielectric constant of the dielectric layer of the developing roller; a thickness, a dielectric constant, and specific resistance of the resistance layer of the developing roller; a potential of a non-exposure region and an exposure saturation potential both on the photosensitive body before entering into a developing portion; a specific charge of the toner before entering into the developing portion; a nip width of the developing portion; a peripheral speed ratio of the photosensitive body and developing roller; etc. Hence, the design of the apparatus becomes complicated, which results in a problem that the cost is undesirably increased.

Neither JP-A 1-230079 nor JP-A 3-87759 supra discloses an equation indicating the developing conditions using each of the foregoing parameters.

SUMMARY OF THE INVENTION

It is therefore an object of the invention to provide a developing apparatus provided with a dielectric developing roller, in which optimal developing conditions to upgrade an image quality during image formation can be readily set, thereby making it possible to achieve cost reduction by facilitating the design of the apparatus.

The invention has the following arrangements as means to solve the problems discussed above.

The invention provides a developing apparatus for developing an electrostatic. latent image into a toner image, comprising:

a developing roller including a conductive substrate, and a resistance layer and a dielectric layer which are formed on a surface of the conductive substrate, the developing apparatus developing at a developing portion where the developing roller contacts a photosensitive body including a conductive substrate and a photosensitive layer formed on a surface of the conductive substrate, by a predetermined nip width, an electrostatic latent image formed on the photosensitive layer into a toner image by layered toner carried on a peripheral surface of the developing roller, wherein a relation expressed by the following Equation (1) is established:

$$Cc \geqq \rho t \cdot dt \cdot k / Vv \quad (1)$$

wherein $$Vv = -(Vbp + Vpr) - Vco + Vt \cdot k$$

$$Cc = 1/\{1/Cp + 2/Ct + rr/k + 1/(Cr3 \cdot k)\}$$

$$k = vr/vp$$

$$rr = \rho r \cdot d2$$

$$Cp = \in p/dp$$

$$Ct = 2 \in t/dt$$

$$Cr1 = \in 1/d1$$

$$Cr2 = \in 2/d2$$

$$C1 = 1/\{1/Cp + 2/Ct + 1/(Cr1 \cdot k)\}$$

$$C2 = k \cdot Cr2$$

$$Ex = (W/vp)/\{rr \cdot (C1 + C2)\}$$

$$Cr3=Cr1\cdot\{1-C1/(C1+C2)\}\cdot\exp(-Ex)$$

$$\rho t=(qpm+qr)\cdot m/dt$$

$$Vco=-qpm\cdot m/Cr1$$

$$Vpr=-qr\cdot m\cdot k/Cp$$

$$Vt=\rho t\cdot dt/Ct,$$

wherein dp (m) and sp (F/m) are thickness and dielectric constant of the photosensitive layer of the photosensitive body, respectively, dt (m), ∈t (F/m) and m (kg/m$^2$) are thickness, dielectric constant and amount of adhesion per unit area of a toner layer formed on the photosensitive body, respectively, d1 (m) and ∈1 (F/m) are thickness and dielectric constant of the dielectric layer of the developing roller, respectively, d2 (m), ∈2 (F/m) and ρr (Ω·m) are thickness, dielectric constant, specific constant of the resistance layer of the developing roller, respectively, Vbp (=Vs−Vb) (V) is potential difference between photosensitive body surface potential Vs (V) in a saturation image density region on the photosensitive body before entering into the developing portion and developing bias Vb (V), qpm (C/kg) is specific charge of toner before entering into the developing portion, Vco (V) is voltage of the dielectric layer of the developing roller before entering into the developing portion, qr (C/kg) is amount of change in specific charge of the toner caused by passing through the developing portion, W (m) is nip width of the developing portion, vp (m/s) is peripheral speed of the photosensitive body, and vr (m/s) is peripheral speed of the developing roller.

In the invention, the developing conditions that exert influence upon a developing state during the developing process, including: the thickness and dielectric constant of the photosensitive layer of the photosensitive body; the thickness, dielectric constant and amount of adhesion per unit area of the toner layer formed on the developing roller; the thickness and dielectric constant of the dielectric layer of the developing roller; the thickness, dielectric constant and specific resistance of the resistance layer of the developing roller; a potential of a non-exposure region and an exposure saturation potential both on the photosensitive body before entering into the developing portion; the specific charge of toner before entering into the developing portion; the nip width of the developing portion; and the peripheral speed ratio of the photosensitive body and the developing roller, are set so as to satisfy Equation (1). Equation (1) is a conditional expression to attain developing efficiency of 100%, at which the layer of toner carried on the outer surface of the developing roller is allowed to migrate entirely to the photosensitive body. Hence, when each developing condition satisfies Equation (1) above, toner migrates from the developing roller to the photosensitive body in a reliable manner, thereby enhancing the developing efficiency.

According to the invention, by setting the developing conditions that exert influence upon the developing state during the developing process, including: the thickness and dielectric constant of the photosensitive layer of the photosensitive body; the thickness, dielectric constant and amount of adhesion per unit area of the toner layer formed on the developing roller; the thickness and dielectric constant of the dielectric layer of the developing roller; the thickness, dielectric constant, and specific resistance of the resistance layer of the developing roller; the potential of the non-exposure region and the exposure saturation potential both on the photosensitive body before entering into the developing portion; the specific charge of toner before entering into the developing portion; the nip width of the developing portion; and the peripheral speed ratio of the photosensitive body and developing roller, so as to satisfy the relation expresses as Cc≧ρt·dt·k/Vv, it is possible to allow the toner to migrate from the developing roller to the photosensitive body in a reliable manner, and therefore, to achieve a satisfactory image density by enhancing the developing efficiency.

The invention is characterized in that Equation (1) is modified to:

$$Cc\geqq\rho t\cdot dt\cdot k/(Vo-V1),$$

wherein Vo is potential in a non-exposure region of the photosensitive body and V1 (V) is exposure saturation potential on the photosensitive body before entering -into the developing portion.

In the invention, the developing conditions are set based on the conditional expression with consideration given to a potential difference between the potential of the non-exposure region and the exposure saturation potential of the exposure region both on the photosensitive body before entering into the developing portion. This allows to secure satisfactory developing efficiency within an effective developing potential width representing a potential difference between the non-exposure region and exposure region on the photosensitive body, thereby inhibiting the occurrence of a fog of an image even when an image density is high.

The invention is characterized in that Equation (1) is modified to:

$$Cc\geqq\rho t\cdot dt\cdot k/\{Vo-V1-Vm\cdot\mathrm{Sign}(Vo)$$

wherein Sign(n)=1, Sign(−n)=−1 when n>0, and Vm (V) is operation margin.

In the invention, the developing conditions are set based on the conditional expression with consideration given to the operation margin with respect to the effective developing potential width. Hence, even when a developing potential varies with a difference among individual apparatuses, an environmental change, etc., it is possible to secure satisfactory developing efficiency within the effective developing potential width.

In the invention, it is preferable to set Vm=100 (V)

According to the invention, satisfactory developing efficiency can be secured within a predetermined effective developing potential width, thereby making it possible to prevent a fog of an image without impairing tone reproduction of the image.

The invention is characterized in that Equation (1) is modified to:

$$Cc\leqq\rho t\cdot dt\cdot k/(Vo/3).$$

In the invention, the developing conditions are set so that satisfactory developing efficiency can be secured within ⅓ the region of-the potential of the non-exposure region on the photosensitive body before entering into the developing portion. This allows adjustment of the developing efficiency within at least ⅓ the region of the photosensitive body potential, thereby making it possible to render satisfactory tone reproduction on an image.

The invention is characterized in that:

$$(W/vp)>\{rr\cdot(C1+C2)\}.$$

In the invention, deterioration in response caused by a time constant of an electric circuit formed at the developing portion can be prevented. Hence, it is possible to prevent inconveniences such that an image is not formed due to deterioration in response.

According to the invention, by setting the developing conditions so as to prevent deterioration in response caused by a time constant of the electric circuit formed at the developing portion, it is possible to prevent inconveniences such that an image is not formed due to deterioration in response.

The invention is characterized in that:

$$1/Cp+2/Ct+rr/k \geqq 4/(Cr3 \cdot k).$$

In the invention, deterioration in response caused by a time constant of the electric circuit formed at the developing portion is controlled to fall within20%. Thus, the developing efficiency never drops to 80% or below by deterioration in response, thereby making it possible to maintain a satisfactory image forming state.

BRIEF DESCRIPTION OF THE DRAWINGS

Other and further objects, features, and advantages of the invention will be more explicit from the following detailed description taken with reference to the drawings wherein.

DETAILED DESCRIPTION OF THE PREFERRED EMBODIMENT

Figure 1:
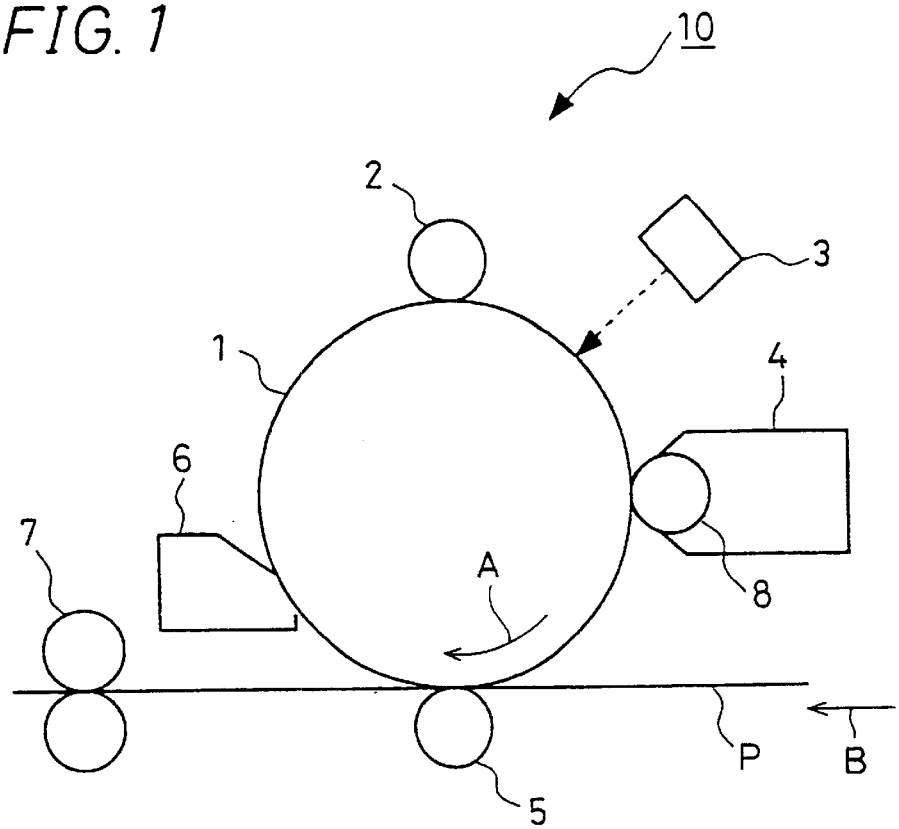
FIG. 1 is a view showing an arrangement of a processing section in an image forming apparatus employing a developing apparatus in accordance with one embodiment of the invention.

Now referring to the drawings, preferred embodiments of the invention are described below.

FIG. 1 is a view showing an arrangement of a processing section in an image forming apparatus employing a developing apparatus in accordance with one embodiment of the invention. A processing section 10 in the image forming apparatus for performing electrophotographic image forming processing includes a photosensitive drum 1 allowed to rotate in a rotation direction A, which is surrounded by a charger 2, an exposure unit 3, a developing unit 4, a transfer apparatus 5, and a cleaner 6 placed in this order from upstream to downstream along the rotation direction A, and a pair of fusing rollers 7 placed downstream from an opposing position of the photosensitive drum 1 and transfer apparatus 5 in a transportation direction B of a sheet of paper P (hereinafter, referred to as the sheet P) used as a recording medium of the invention.

Figure 2:
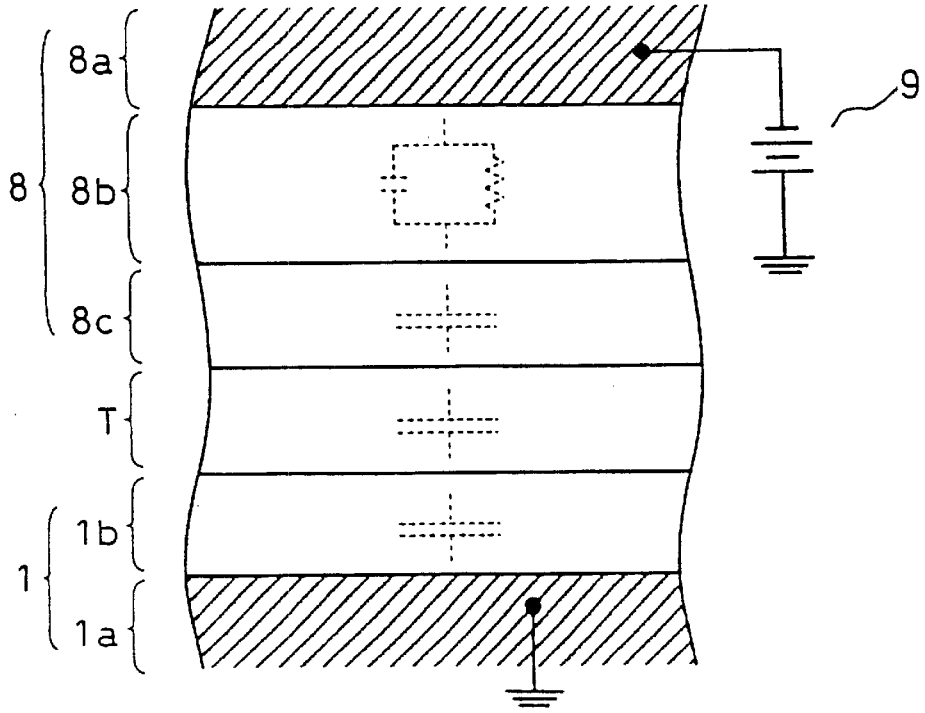
FIG. 2 is a view schematically showing a state of a developing portion in the processing section.

The photosensitive drum 1 is an image carrier of the invention, and composed of a cylindrical conductive substrate 1*a* made of aluminum or the like and a photosensitive layer 1*b* covering the surface of the substrate 1*a* for inducing a photoconductive function (see FIG. 2). The charger 2 is composed of a brush or a roller, and brought into contact with the surface of the photosensitive drum 1 at its tip or outer surface to provide charges of a single polarity evenly on the surface of the photosensitive drum 1. The exposure unit 3 irradiates light of an image based on image data to the surface of the photosensitive drum 1 after it is charged by the charger 2. The photosensitive layer 1*b* on the surface of the photosensitive drum 1 induces a photoconductive function at a portion irradiated by the light of the image. As a result, an electrostatic latent image is formed on the surface of the photosensitive drum 1. The developing unit 4 contains toner charged to a predetermined polarity in its interior, and develops the electrostatic latent image into a visible toner image by supplying the toner on the surface of the photosensitive drum 1 by means of a developing roller 8.

The transfer apparatus 5 is applied with a predetermined transfer voltage from a power source circuit, which will be described below. The transfer apparatus 5 composed of a roller, a brush, a film or the like is transferring means of a contact transfer method that nips the sheet P transported along the transportation direction B and presses the sheet P against the surface of the photosensitive drum 1 at a predetermined pressing pressure in association with a rotation of the photosensitive drum 1 in the rotation direction A. The cleaner 6 removes the toner or the like remaining on the surface of the photosensitive drum 1 after the transfer process. The pair of fusing rollers 7 heat and apply a pressure on the sheet P having undergone the transfer process, so that the toner image transferred onto the sheet P is fused and fixed on the surface of the sheet P steadfastly.

The developing unit 4 includes the developing roller 8, which is pressed against the surface of the photosensitive drum 1 at a contact portion (hereinafter, referred to the nip portion) with a predetermined width. At the nip portion, a layer of toner carried on the surface of the developing roller 8 adheres electrostatically to an electrostatic latent image formed on the surface of the photosensitive drum 1, whereupon a toner image is formed. In other words, the nip portion is a developing portion where a developing electric field is developed by a developing bias voltage applied to the developing roller 8. The developing roller 8 is composed of a cylindrical conductive substrate 8*a* having a resistance layer 8*b* and a dielectric layer 8*c* formed on its surface in this order.

In the processing section 10 arranged in this manner, when toner T (assume that it is charged to the positive (+) polarity) forming the toner image carried on the surface of the photosensitive drum 1 comes to oppose the sheet P as the photosensitive drum 1 rotates in the rotation direction A, the toner T migrates from the surface of the photosensitive drum 1 to the surface of the sheet P by a transfer voltage of the negative (−) polarity applied to the transfer apparatus 5. As a result, a non-fused toner image is formed on the surface of the sheet P.

Figure 3:
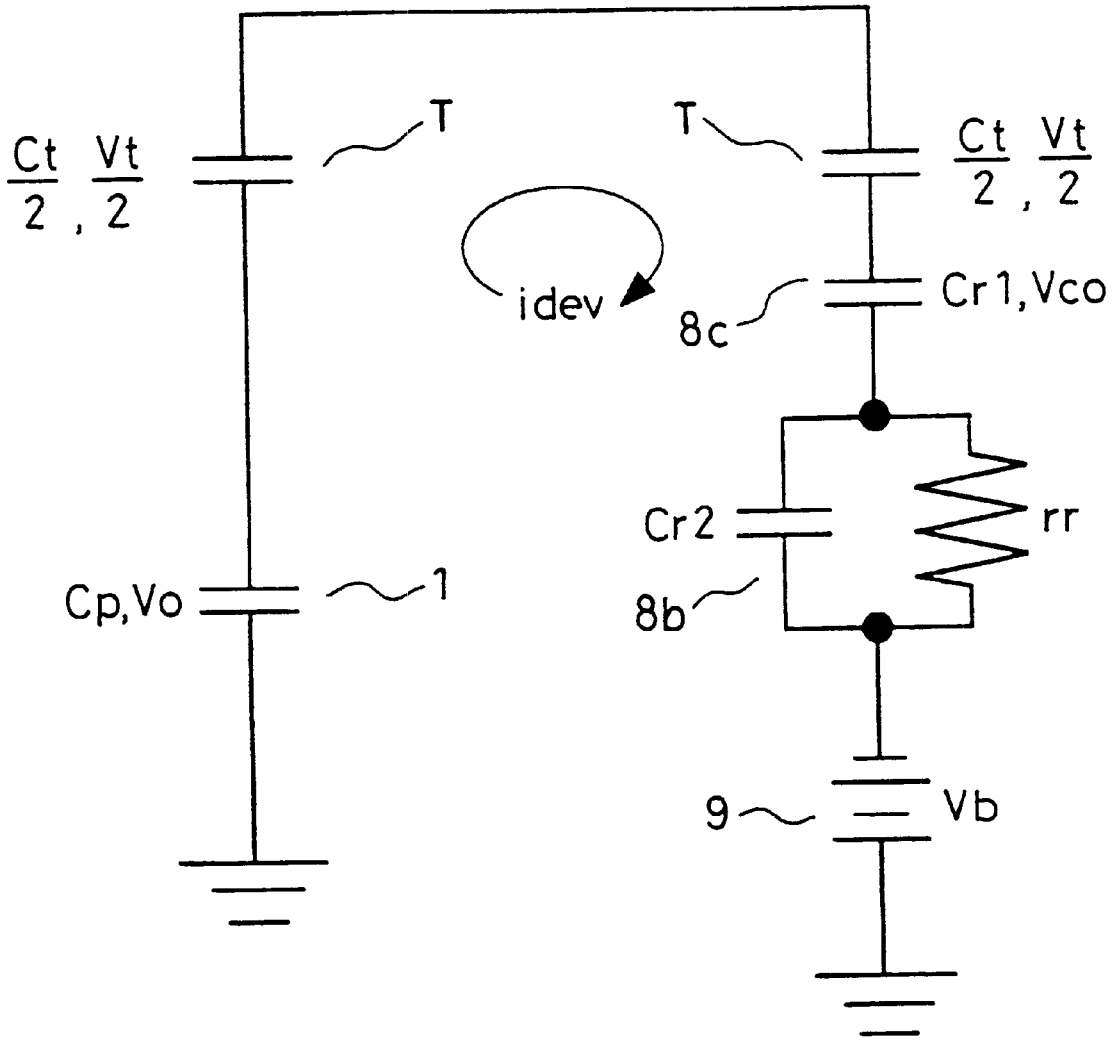
FIG. 3 is an equivalent circuit diagram of the developing portion.

FIG. 2 is a view schematically showing a state of the developing portion in the processing section 10. As has been described, at the developing portion in the processing section 10, the developing roller 8 having thereon formed a toner layer T presses against the surface of the photosensitive drum 1 having formed thereon an electrostatic latent image. The conductive substrate 1*a* of the photosensitive drum 1 is provided with the photosensitive layer 1*b* on its surface and the conductive substrate 1*a* is grounded. The developing roller 8 is composed of a conductive substrate 8*a,* a resistance layer 8*b* and a dielectric layer 8*c*. The resistance layer 8*b* is formed on the surface of the conductive substrate 8*a*. The dielectric layer 8*c* is formed on the surface of the resistance layer 8*b*. A developing bias voltage is applied to the conductive substrate 8*a* from a power source circuit 9. The photosensitive layer 1*b* of the photosensitive drum 1, toner layer T, and the dielectric layer 8*c* of the developing roller 8 have their respective electrostatic capacities Cp, Ct, and Cr1. Also, the resistance layer 8*b* of the developing roller 8 has its own electrostatic capacity Cr2 and resistance value rr. Further, the photosensitive layer 1*b* of the photosensitive drum 1 is given with a potential Vo from the charger 2, and toner forming the toner layer T is given with a specific charge pqm in the interior of the developing unit 4. The dielectric layer 8*c* of the developing roller 8 has potential Vco through frictional electrification with toner in a developing container and on developing bias voltage Vb applied from the power source circuit 9 or the like. Hence, assume that a half of the toner forming the toner layer T carried on the surface of the developing roller 8 has been electrostatically adhered to the surface of the photosensitive drum 1, then an electrical arrangement of the developing portion is a state shown as an equivalent circuit diagram of FIG. 3.

In the invention, developing conditions are set so as to satisfy the following Equation (1):

$$Cc \geqq \rho t \cdot dt \cdot k / Vv \tag{1}$$

wherein $$Vv = -(Vbp + Vpr) - Vco + Vt \cdot k$$

$$Cc = 1/\{1/Cp + 2/Ct + rr/k + 1/(Cr3 \cdot k)\}$$

$$k = vr/vp$$

$$rr = \rho r \cdot d2$$

$$Cp = \in p/dp$$

$$Ct = 2 \cdot \in t/dt$$

$$Cr1 = \in 1/d1$$

$$Cr2 = \in 2/d2$$

$$C1 = 1/\{1/Cp + 2/Ct + 1/(Cr1 \cdot k)\}$$

$$C2 = k \cdot Cr2$$

$$Ex = (W/vp)/\{rr \cdot (C1 + C2)\}$$

$$Cr3 = Cr1 \cdot \{1 - C1/(C1 + C2)\} \cdot \exp(-Ex)$$

$$\rho t = (qpm + qr) \cdot m/dt$$

$$Vco = -qpm \cdot m/Cr1$$

$$Vpr = -qr \cdot m \cdot k/Cp$$

$$Vt = \rho t \cdot dt/Ct,$$

wherein dp (m) and ∈p (F/m) are thickness and dielectric constant of the photosensitive layer 1*b* of the photosensitive drum 1, respectively, dt (m), ∈t (F/m) and m (kg/m$^2$) are thickness, dielectric constant and amount of adhesion per unit area of the toner layer T formed on the surface of the developing roller 8 before development, respectively, d1 (m) and ∈1 (F/m) are thickness and dielectric constant of the dielectric layer 8*c* of the developing roller 8, respectively, d2 (m), ∈2 (F/m) and ρr (Ω·m) are thickness, dielectric constant and specific resistance of the resistance layer 8*b* of the developing roller. 8, respectively, Vbd (=Vs−Vb) (V) is potential difference between photosensitive body surface potential Vs (V) in a saturation image density region on the photosensitive drum 1 before entering into the developing portion and developing bias Vb (V), qpm (C/kg) is specific charge of toner before entering into the developing portion, Vco (V) is voltage of the dielectric layer 8*c* of the developing roller 8 before entering into the developing portion, qr (C/kg) is amount of change in specific charge of the toner caused by passing through the developing portion, W (m) is nip width of the developing portion, vp (m/s) is peripheral speed of the photosensitive drum 1, and vr (m/s) is peripheral speed of the developing roller 8.

When the relation expressed by Equation (1) is satisfied, the toner layer T carried on the surface of the developing roller 8 migrates to the photosensitive drum 1 entirely. In other words, Equation (1) is a conditional expression to attain developing efficiency of 100%. Hence, by setting the developing conditions, such as the thickness dp and dielectric constant ∈p of the photosensitive layer 1*b* of the photosensitive drum 1, the thickness dt, dielectric constant ∈t, and amount of adhesion per unit area m of the toner layer T formed on the developing roller 8, the thickness d1 and dielectric constant ∈1 of the dielectric layer 8*c* of the developing roller 8, the thickness d2, dielectric constant ∈2, and specific resistance ρr of the resistance layer 8*b* of the developing roller 8, the potential Vo of the non-exposure region and the exposure saturation potential Vs both on the photosensitive drum 1 before entering into the developing portion, the specific charge qpm of the toner before entering into the developing portion, the nip width W of the developing portion, peripheral speed ratio vr/vp of the photosensitive drum 1 and developing roller 8, etc., so as to satisfy the relation expressed by Equation (1), a sufficient amount of toner adheres electrostatically to the electrostatic latent image formed on the photosensitive drum 1, whereby it is possible to upgrade the image quality by preventing a drop in image density.

The following description will verify that the developing efficiency is enhanced by setting the developing conditions to satisfy the relation expressed by Equation (1).

Figure 4:
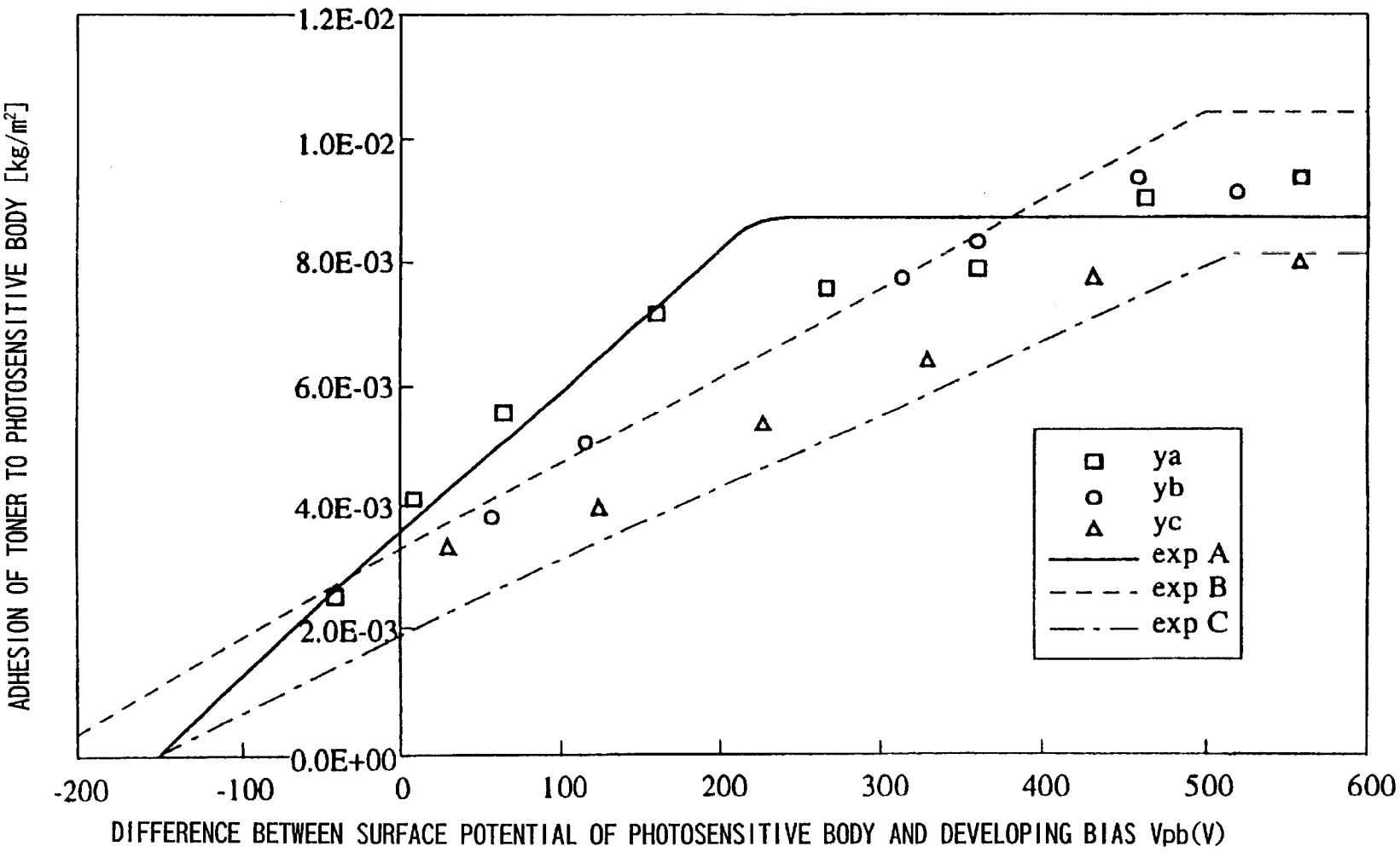
FIG. 4 is a view showing a comparison of developing conditions computed by using a basic expression of development which is a base of a relational expression-used in setting developing conditions in the developing apparatus of the invention with experimental values.
Figure 5:
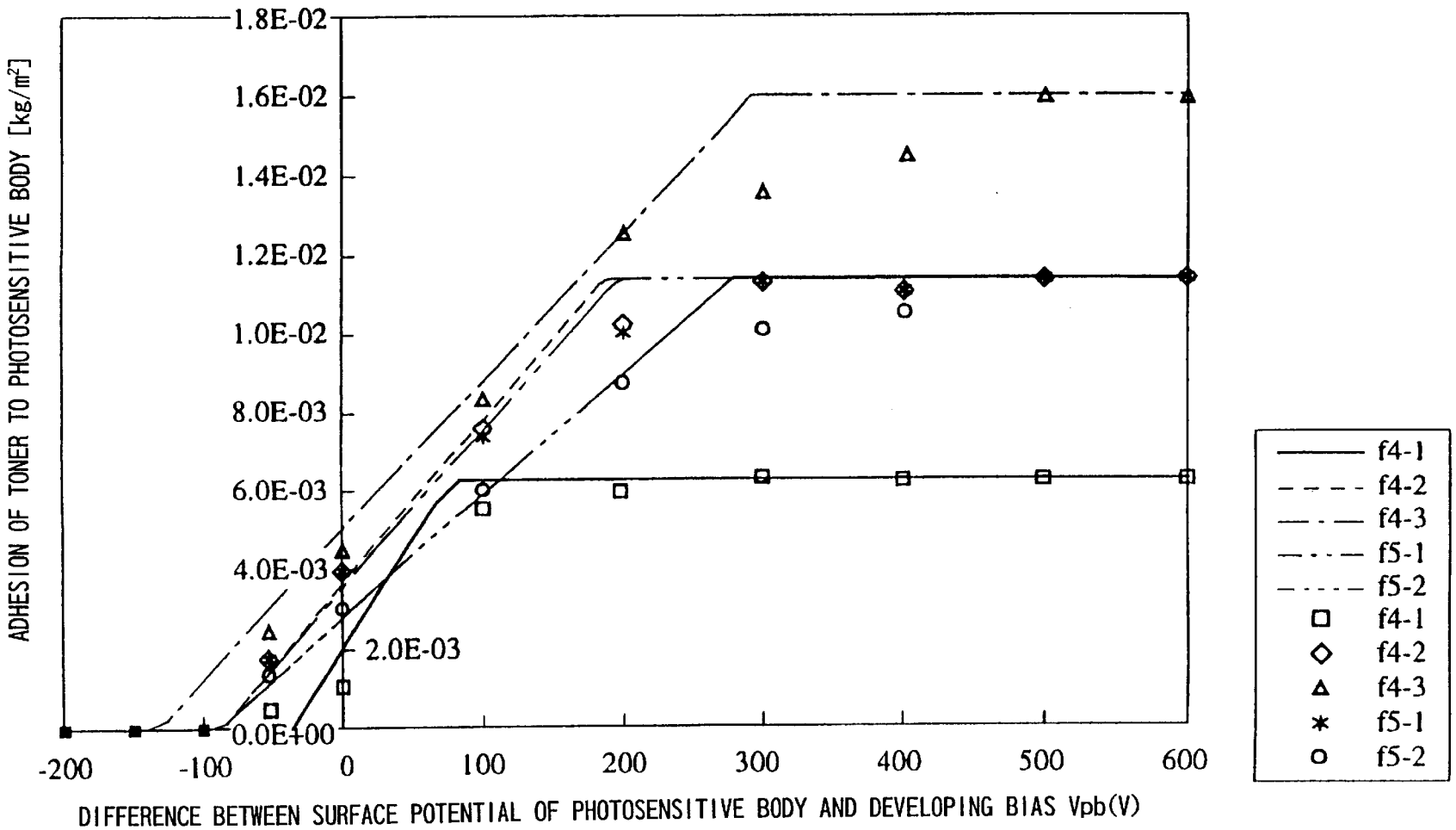
FIG. 5 is a view showing a comparison of the computed developing conditions with experimental values.

The amount of adhesion of toner md[kg/m$^2$] which adheres. to the photosensitive drum 1 in order to develop an electrostatic latent image formed on the photosensitive drum 1 is represented by the following Equation (1'):

$$md = \frac{1}{qpm} \cdot Vv \cdot Cc \tag{1'}$$

wherein $$Vv = -(Vbp + Vpr) - Vco + Vt \cdot k$$

$$Cc = 1/\{1/Cp + 2/Ct + rr/k + 1/(Cr3 \cdot k)\}$$

$$k = vr/vp$$

$$rr = \rho r \cdot d2$$

$$Cp = \in p/dp$$

$$Ct = 2 \cdot t/d$$

$$Cr1 = \in 1/d1$$

$$Cr2 = \in 2/d2$$

$$C1 = 1/\{1/Cp + 2/Ct + 1/(Cr1 \cdot k)\}$$

$$C2 = k \cdot Cr2$$

$$Ex = (W/vp)/\{rr \cdot (C1 + C2)\}$$

$$Cr3 = Cr1 \cdot \{1 - C1/(C1 + C2)\} \cdot \exp(-Ex)$$

$$\rho t = (qpm + qr) \cdot m/dt$$

$$Vco = -qpm \cdot m/Cr1$$

$$Vpr=-qr\cdot m\cdot k/Cp$$

$$Vt=\rho t\cdot dt/Ct$$

$$Vpb=Vd-Vb,$$

wherein dp (m) and ∈p (F/m) are thickness and dielectric constant of the photosensitive layer of the photosensitive body, respectively, dt (m), Et (F/m) and m (kg/m$^2$) are thickness, dielectric constant and amount of adhesion per unit area of a toner layer formed on the photosensitive body, respectively, d1 (m) and ∈1 (F/m) are thickness and dielectric constant of the dielectric layer of the developing roller, respectively, d2 (mi), ∈2 (F/m) and ρr (Ω·m) are thickness, dielectric constant, and specific constant of the resistance layer of the developing roller, respectively, Vbp (=Vs−Vb) (V) is potential difference between photosensitive body surface potential Vs (V) in a saturation image density region on the photosensitive body before entering into the developing portion and developing bias Vb (V), qpm (C/kg) is specific charge of toner before entering into the developing portion, Vco (V) is voltage of the dielectric layer of the developing roller before entering into the developing portion, qr (C/kg) is amount of change in specific charge of the toner caused by passing through the developing portion, W (m) is nip width of the developing portion; vp (m/s) is peripheral speed of the photosensitive body, vr (m/s) is peripheral speed of the developing roller, and Vd (V) is arbitrary photosensitive body surface potential. Equation (1) is obtained from Equation (1'). FIGS. 4 and 5 show comparison results of computation values using Equation (1') with experimental values as to a relation of a potential difference Vpb (V) (Vpb=Vd−Vb) between the photosensitive drum 1 of an arbitrary photosensitive body surface potential Vd (V) and a developing bias versus amount of adhesion of the toner layer of the photosensitive drum 1 when the developing conditions are set so as to satisfy Equation (1). FIG. 4 shows a comparison result of the computation values indicated by lines in the drawing with experimental values disclosed in JP-A 1-230079 supra, and FIG. 5 shows a comparison result of the computation values indicated by lines in the drawing with experimental values disclosed in JP-A 3-87759 supra.

The experimental values disclosed in JP-A 1-230079 supra are those related to a developing portion employing a developing roller having a dielectric layer formed on its surface. The experimental values disclosed in JP-A 3-87759 supra are those related to a developing portion employing a developing roller omitting a dielectric layer from its surface.

In FIG. 4, expA through expC are lines computed by matching the properties respectively to those of toners A through C whose experimental values are disclosed in JP-A 1-230079 supra. Further, in FIG. 5, f4-1 through f4-3 are lines computed on the assumption that peripheral speed ratios of the photosensitive drum and developing roller are 1.30, 2.36, 3.32, respectively, while f5-1 and f5-2 are lines computed on the assumption that resistance values of the photosensitive layer of the developing roller 8 are $1.1\times10^5$ Ωm$^2$ and $1.3\times10^6$ Ωm$^2$, respectively.

As are shown in FIGS. 4 and 5, the computation values as to the relation of an amount of adhesion of toner versus a potential difference of the photosensitive drum 1 become substantially equal to the experimental values by setting the developing conditions so as to satisfy the relation expressed by Equation (1). Hence, by setting the developing conditions at the developing portion so as to satisfy the relation expressed by Equation (1), it is assumed that computation values equivalent to the experimental values can be obtained, and therefore, it is possible to set the developing conditions such that a developing efficiency of 100% or nearly 100% with Equation (1) is achieved.

Equation (1) is a conditional expression, in which neither of the potential (exposure saturation potential) V1 of the exposure region nor the voltage Vo of the non-exposure region both on the photosensitive layer 1*b* of the photosensitive drum 1 is expressed directly. In practice, however, the potential of the exposure region on the photosensitive layer 1*b* of the photosensitive drum 1, which is irradiated by light of an image emitted from the exposure unit 3 after it is supplied with charges from the charger 2, does not necessarily become "0". Hence, when consideration is given to the potential V1 (V) of the exposure region and the potential Vo (V) of the non-exposure region both on the photosensitive layer 1*b* of the photosensitive drum 1 before entering into the developing portion, the developing conditions should be set so as to satisfy the following Equation (2) obtained by modifying Equation (1) in a simpler manner:

$$Cc\geqq\rho t\cdot dt\cdot k/(Vo-V1) \quad (2)$$

Consequently, it is possible to set developing conditions with consideration given to an effective developing potential width, which is a potential difference between the non-exposure region and exposure region on the photosensitive layer 1*b* of the photosensitive drum 1 before entering into the developing portion. This allows to secure satisfactory developing efficiency within the effective developing potential width representing a potential difference between the non-exposure region and exposure region on the photosensitive layer 1*b*, thereby inhibiting the occurrence of a fog of an image even when an image density is high.

Also, given Vm as an operation margin of the developing unit 4, then Equation (1) above can be modified to:

$$Cc\geqq\rho t\cdot dt\cdot k/\{Vo-V1-Vm\cdot \mathrm{Sign}(Vo)\} \quad (3)$$

wherein Sign(n)=1, Sign(−n)=−1 when n>0, so that the developing conditions can be set based on the conditional expression with consideration given to the operation margin of the developing unit 4 with respect to the effective developing potential width. Consequently, even when a developing potential varies with a difference among individual apparatuses, an environmental change, etc., it is possible to secure satisfactory developing efficiency within the effective developing potential width.

In this case, the adequate operation margin Vm of the developing unit 4 is approximately 100 (V). This is because satisfactory tone reproduction of an image can be achieved when a width of variance of the developing potential caused by a difference among individual-apparatuses, an environmental change, etc. is approximately 100 (V) and within a range approximately 100 (V) narrower than the effective developing potential width.

Further, Equation (1) can be modified to:

$$Cc\geqq\rho t\cdot dt\cdot k/(Vo/3) \quad (4),$$

so that the developing conditions can be set so as to secure satisfactory developing efficiency within ⅓ the region of the potential of the non-exposure region on the photosensitive layer 1*b* before entering into the developing portion. This allows adjustment of developing efficiency within at least ⅓ the region of the photosensitive body potential, thereby making it possible to render satisfactory tone reproduction on an image.

In addition, in computation of equation (1), b(W/vp)>{rr·(C1+C2)} may be applied. This makes it possible to prevent deterioration in response caused by a time constant of an electric circuit formed at the developing portion, thereby eliminating inconveniences such that an image is not formed due to deterioration in response.

Also, in computation of Equation 1, $$1/Cp+2/Ct+rr/k \geqq 4/(Cr3 \cdot k)$$

may be applied. Consequently, it is possible to control deterioration in response caused by a time constant of the electric circuit formed at the developing portion to fall within 20%. Thus, the developing efficiency never drops to 80% or below by deterioration in response, thereby making it possible to maintain a satisfactory image forming state.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. A developing apparatus for developing an electrostatic latent image into a toner image, comprising:

a developing roller including a conductive substrate, and a resistance layer and a dielectric layer which are formed on a surface of the conductive substrate, the developing apparatus developing at a developing portion where the developing roller contacts a photosensitive body including a conductive substrate and a photosensitive layer formed on a surface of the conductive substrate, by a predetermined nip width, an electrostatic latent image formed on the photosensitive layer into a toner image by layered toner carried on a peripheral surface of the developing roller, wherein a relation expressed by the following Equation (1) is established:

$$Cc \geqq \rho t \cdot dt \cdot k / Vv \quad (1)$$

wherein $$Vv = -(Vbp + Vpr) - Vco + Vt \cdot k$$

$$Cc = 1/\{1/Cp + 2/Ct + rr/k + 1/(Cr3 \cdot k)\}$$

$$k = vr/vp$$

$$rr = \rho r \cdot d2$$

$$Cp = \in p/dp$$

$$Ct = 2 \cdot \in t/dt$$

$$Cr1 = \in 1/d1$$

$$Cr2 = \in 2/d2$$

$$C1 = 1/\{1/Cp + 2/Ct + 1/(Cr1 \cdot k)\}$$

$$C2 = k \cdot Cr2$$

$$Ex = (W/vp)/\{rr \cdot (C1 + C2)\}$$

$$Cr3 = Cr1 \cdot \{1 - C1/(C1 + C2)\} \cdot \exp(-Ex)$$

$$\rho t = (qpm + qr) \cdot m/dt$$

$$Vco = -qpm \cdot m/Cr1$$

$$Vpr = -qr \cdot m \cdot k/Cp$$

$$Vt = \rho t \cdot dt/Ct,$$

wherein dp (m) and $\in$p (F/m) are thickness and dielectric constant of the photosensitive layer of the photosensitive body, respectively, dt (m), $\in$t (F/m) and m (kg/m$^2$) are thickness, dielectric constant and amount of adhesion per unit area of a toner layer formed on the photosensitive body, respectively, d1 (m) and $\in$1 (F/m) are thickness and dielectric constant of the dielectric layer of the developing roller, respectively, d2 (m), $\in$2 (F/m) and ρr (Ω·m) are thickness, dielectric constant, and specific constant of the resistance layer of the developing roller, respectively, Vbp (=Vs−Vb) (V) is potential difference between photosensitive body surface potential Vs (V) in a saturation image density region on the photosensitive body before entering into the developing portion and developing bias Vb (V), qpm (C/kg) is specific charge of toner before entering into the developing portion, Vco. (V) is voltage of the dielectric layer of the developing roller before entering into the developing portion, qr (C/kg) is amount of change in specific charge of the toner caused by passing through the developing portion, W (m) is nip width of the developing portion, vp (m/s) is peripheral speed of the photosensitive body, and vr (m/s) is peripheral speed of the developing roller.

2. The developing apparatus of claim 1, wherein Equation (1) is modified to:

$$Cc \geqq \rho t \cdot dt \cdot k/(Vo - V1),$$

wherein Vo is potential in a non-exposure region of the photosensitive body and V1 (V) is exposure saturation potential on the photosensitive body before entering into the developing portion.

3. The developing apparatus of claim 2, wherein Equation (1) is modified to:

$$Cc \geqq \rho t \cdot dt \cdot k/\{Vo - V1 - Vm \cdot \mathrm{Sign}(Vo)$$

wherein Sign(n)=1, Sign(−n)=−1 when n>0, and Vm (V) is operation margin.

4. The developing apparatus of claim 3, wherein Equation (1) is modified to:

$$Cc \geqq \rho t \cdot dt \cdot k/(Vo/3).$$

5. The developing apparatus of claim 1, wherein $$(W/vp) > \{rr \cdot (C1 + C2)\}.$$

6. The developing apparatus of claim 1, wherein $$1/Cp + 2/Ct + rr/k \geqq 4/(Cr3 \cdot k).$$

* * * * *